United States Patent [19]

Lisnay

[11] 4,077,024

[45] Feb. 28, 1978

[54] MULTI-POLE CIRCUIT BREAKER

[75] Inventor: Albert D. Lisnay, Sarasota, Fla.

[73] Assignee: Heinemann Electric Company, Trenton, N.J.

[21] Appl. No.: 707,626

[22] Filed: Jul. 22, 1976

[51] Int. Cl.[2] ..... H01H 71/02

[52] U.S. Cl. ..... 335/8; 335/10

[58] Field of Search ..... 335/8, 9, 10, 132, 202; 200/303

[56] References Cited

U.S. PATENT DOCUMENTS

| | | | |
|---|---|---|---|
| 2,913,542 | 11/1959 | Myers | 335/10 |
| 3,832,663 | 8/1974 | Gelzheiser | 335/202 |
| 3,842,376 | 10/1974 | Mune | 335/8 |

*Primary Examiner*—Harold Broome

*Attorney, Agent, or Firm*—Joseph G. Denny, III; Peter J. Patane

[57] ABSTRACT

A molded case circuit breaker comprising a case divided longitudinally into two approximate half cases. Each case defines an arcing chamber. Further, each half case has a side wall, an end wall, and a top wall. The end walls of each half case define an opening through which the arc gases are vented. The top walls of each half case define an inverted U-shaped cavity. A V-shaped screen has one leg thereof placed against the end walls to restrict the opening. The other leg of the V-shaped screen extends into the U-shaped cavity, but is spaced from the wall defining the U-shaped cavity. The V-shaped screen has legs which are spaced apart to provide a space through which the arc gases may pass. The circuit breaker also includes a stationary contact surrounded on all sides but one by an arc runner which is keyed to a supporting conductor. Further, two or more circuit breaker poles may be interconnected at their handle links with only one handle link extending outwardly of deep wells formed by portions of the half cases for manual operation of the multi-pole circuit breaker formed thereby.

5 Claims, 5 Drawing Figures

FIG. 3
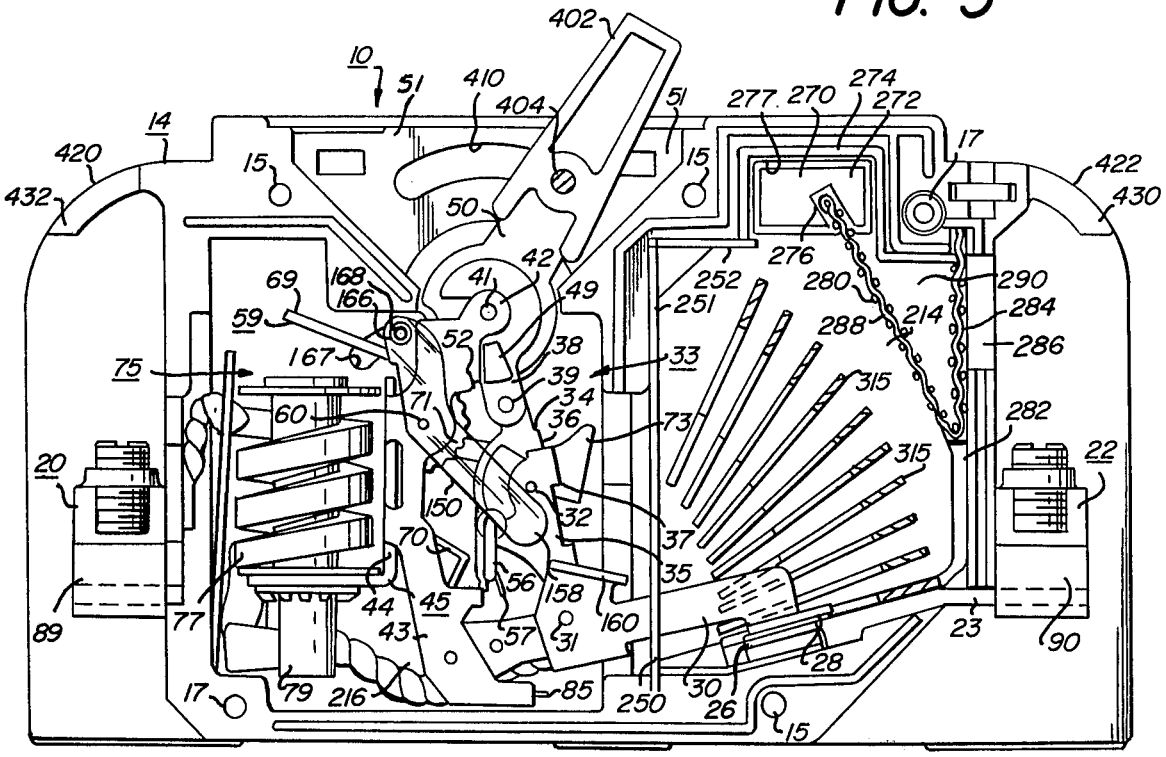
FIG. 4
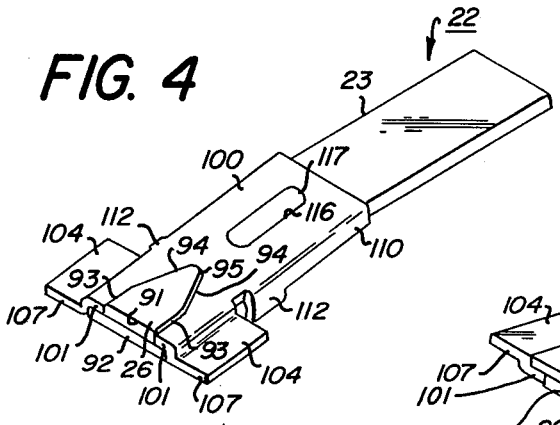
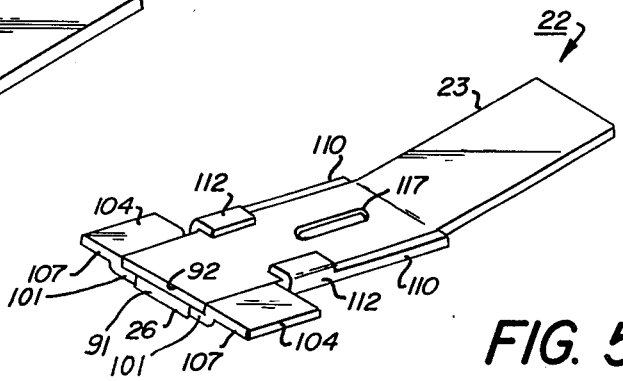
FIG. 5

MULTI-POLE CIRCUIT BREAKER

BACKGROUND OF THE INVENTION

This invention relates generally to molded case electric circuit breakers.

It is desired to modify the molded case circuit breaker shown in U.S. Pat. No. 3,842,376 so as to have a rating of 100 amperes at 480 volts, alternating current, and to safely interrupt a current of 10,000 amperes.

BRIEF SUMMARY OF THE INVENTION

Thus, it is an object of this invention to modify a known molded case circuit breaker so as to increase its rated current capacity and rated interrupting current capacity.

The circuit breaker shown in U.S. Pat. No. 3,842,376 has been modified in this invention to provide for more efficient extinction of the arcs which may arise upon the opening of the contacts. An arc runner is provided which surrounds the stationary contact on all sides of the stationary contact except one. The arc runner is keyed to its supporting conductor and has ears which extend laterally into the half cases of the circuit breaker for the purpose of securing the stationary contact terminal within the half cases of the circuit breaker.

To further assist in safely extinguishing the arcs that may form upon the separation of the circuit breaker contacts, a V-shaped screen is placed adjacent to the vent opening of the arcing chamber, so that all of the arc gases must pass through at least one leg of the screen (before venting through the vent opening) and the other portion of the gases pass through both legs of the screen, the screen helping to cool the gases and also restricting oversize particles from exiting through the vent opening.

The circuit breaker is adapted for use as a multi-pole circuit breaker by placing single pole circuit breaker alongside one another and suitably interconnecting the mechanisms of the poles to provide for common tripping of all poles upon the overload tripping of anyone pole, as is well-known in the prior art.

Each circuit breaker is provided with a case structure that forms a deep well into which a portion of the handle link of each circuit breaker mechanism extends. One of the handle links extends out beyond its case to form a handle for manual operation. The other handle links do not extend beyond the well and the well is covered by a suitable plate. Abutting walls of the circuit breaker poles are provided with suitable slots to receive a tie pin which extends through the handle links to interconnect the handle links of all the poles to each other.

The foregoing and other objects of the invention, the principles of the invention and the best mode in which I have contemplated applying such principles will more fully appear from the following description and accompanying drawings in illustration thereof.

BRIEF DESCRIPTION OF THE VIEWS

In the drawings:

FIG. 3 is a side elevation view of the central unit shown in FIG. 1 but at an enlarged scale relative to FIGS. 1 and 2 and showing some of the parts in cross-section, the view being taken generally along the line 3—3 in FIG. 1;

FIG. 4 is a top perspective view of the stationary contact terminal shown in FIG. 3 but at an enlarged scale and omitting the connector; and FIG. 5 is a bottom perspective view of the stationary contact terminal shown in FIG. 4.

DESCRIPTION OF THE PREFERRED EMBODIMENT

Figure 1:
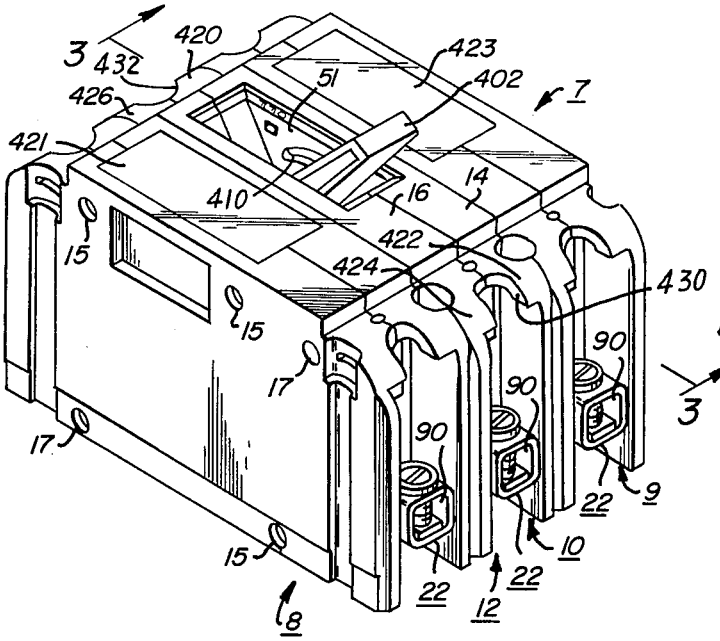
FIG. 1 is a front and top perspective view of a three pole circuit breaker incorporating the present invention.

Referring to the drawings, this invention is embodied in a three pole circuit breaker unit 7 comprising similar poles 8, 9 and 10. For purposes of brevity only, the circuit breaker pole 10 will be described, it being understood that the other poles 8 and 9 are similarly constructed, except as noted.

The three pole circuit breaker unit 7 described herein is a modification of the circuit breaker unit shown in U.S. Pat. No. 3,842,376.

The circuit breaker pole 10 comprises an insulator case 12 molded from a suitable plastic material and divided into approximately two halves 14 and 16 (longitudinally through the width of the circuit breaker unit), as illustrated in FIG. 1, and the two case halves are secured together by suitable rivets 15, FIG. 3. The three poles 8, 9 and 10 are, in turn, secured together by suitable rivets 17.

The circuit breaker pole 10 is provided with terminals 20 and 22 for connecting the unit to a circuit (not shown). Referring to FIG. 3, the terminal 22 includes a flat conductor or strap 23 which carries the stationary contact 26. The stationary contact 26 is engaged by a movable contact 28 carried by a movable arm 30.

The movable arm 30 is part of a linkage means or mechanism 33 which also includes a toggle 34 comprising lower and upper links 35 and 36. The lower link 35 is pivotally connected to the movable arm 30 by a pin 31 at one end and to the upper link 36 at the other end by another pin 32 to form the knee 37 of the toggle 34. The upper link 36 is pivotally connected at the other end to a further link 38 by another pin 39, the link 38 oscillating about a pin 41 supported by extending through openings in two spaced extensions 42 of two parallel and flat (side) plates 43 which together with an L-shaped plate 44 jointly form a frame 45, the opposed side plates 43 being integral with the L-shaped plate 44 and bent toward each other from the vertical portion of the L-shaped plate 44.

The link 38 is integral with an actuator 50 extending through a suitable opening in the case 12 into a deep V-shaped well 51. The actuator 50 and the link 38 are biased to the off position of the contacts by a coiled spring 52 (FIG. 3) wound about the pin 41, the spring 52 being only partially shown in FIG. 3. The spring 52 has one end portion restrained by one of the two frame extensions 42 and the other end portion biased against an extension 49 formed integral with the link 38 and projecting therefrom, the spring end portion being hidden in FIG. 3 by the frame extension 42.

The upper link 36, FIG. 3, is provided with a tooth portion (not shown) for engaging a half moon (not shown) formed on one leg of a U-shaped latch 56 carried by the lower link 35 for locking the toggle 34 in the overcenter position during automatic resetting, the latch 56 being biased, in the clockwise direction, toward engagement with the tooth portion, by a spring 57 which engages the other leg of the latch 56. The latch 56 is tripped by an unlatching end 70 of a pivotal armature 59 which has an attracted end 69 in addition to the unlatching end 70 which engages the latch 56.

Referring to FIG. 3, the side plates 43 carry a pin 60 about which the armature 59 pivots. The armature 59 further includes an integral serrated leg 71 and a balance leg 73 both of which are well known in the art. The armature 59 is biased clockwise by a coil spring (not shown) which is disposed around the pin 60 and has one end portion 61 disposed in a serration of the leg 71 and the other end portion (not shown) engaging one of the frame plates 43.

When the armature end 69 is attracted, upon sufficient overload, sufficiently toward the pole piece 72 of an electromagnet 75 comprising a coil 77 formed about a tube 79, the armature unlatching end 70 engages the latch 56 and turns the latch 56 (against the bias of the spring 57) to present the flat portion of the half moon (not shown) to the tooth portion (not shown), whereupon the toggle 34 collapses under the bias of an opening spring 85, all as is well known in the art, and the movable arm 30 moves upwardly to its contacts open position (not illustrated).

After the toggle 34 collapses, the actuator spring 52 moves the actuator 50 to the contacts open or "off" position, simultaneously resetting the toggle 34 so that the tooth engages the half moon shaft whereupon the actuator 50 may subsequently be rotated to reclose the contacts 26 and 28, all as is known in the art.

The circuit breaker pole 10 also includes a common trip cam 150 which comprises two spaced arms 158 (only one of which is shown in FIG. 3), one of the cam arms 158 being engageable with a drive plate 160 carried by the movable arm 30. The common trip cam 150 also includes a hollow tube 166 extending between the arms 158, the arms 158 and the tube 166 being integral. A rod 168 of electrical insulating material extends through the tube 166 and the corresponding tubes (not shown) of the common trip cams (not shown) of the adjacent poles 8 and 9 to interconnect the poles 8, 9 and 10 for common tripping. The abutting side walls of the poles 8, 9 and 10 are provided with suitable arcuate openings 167 (FIG. 3) through which the rod 168 extends.

Preferably, the common trip cam 150 is formed of plastic, electrical insulating material and the arms 158 are provided with suitable aligned holes to receive the end portions of the armature pin 60, so that the common trip cam 150 is pivotal about the pin 60.

The attractable end 69 of the armature 59 engages the tube 166 so that when the contacts 26 and 28 are closed, the end 69 (under the pressure of the armature spring) rotates the common trip cam 150 clockwise to the position shown in FIG. 3 so that its right hand portion is in position to be engaged (during opening of the contacts) by the left hand portion of the drive plate 160 (as the movable arm 30 rotates counterclockwise).

Upon an overload in one of the three poles 8, 9 or 10, sufficient to trip the pole, the associated armature is rotated about its pin into engagement with and rotates its latch against the bias of the latch spring sufficiently for the tooth to clear the half moon. The overcenter toggle immediately collapses under pressure from the opening spring and the movable arm starts to separate from the stationary contact. Continued movement of the movable arm causes the drive plate to impinge upon the common trip pin and to rotate the common trip cam counterclockwise, since the common trip cams of the two poles are interconnected by the rod 168, all common trip cams pivoting simulateneously.

Because of the aforementioned simultaneous movement of the common trip cams, the tubes (corresponding to the tube 166 in FIG. 3) in the non-overloaded poles force the associated armatures to turn in the direction to unlatch the associated latches, whereby all poles are opened substantially simultaneously, resulting in the virtually simultaneously opening of the contacts of all the poles of the unit.

The terminal 22 constitutes a sub-assembly comprising the conductor 23 (preferably bent at an angle, as shown in FIG. 3), the right hand end of which carries a suitable connector 90. The left hand end of the conductor 23 carries the stationary contact 26 suitably secured thereto, such as by brazing or the like. The stationary contact 26 is secured to the conductor 23 so that one side or end face 91 of the contact 26 is coplanar with, i.e., is cotermineous with, the end face 92 of the conductor 23.

The stationary contact 26 is generally of triangular shape having opposed sides which include generally straight portions 93 and tapered portions 94 which incline towards each other to join at the top, as viewed in FIG. 4, to form a rounded nose 95.

Placed upon the conductor 23 is an arc runner 100 of magnetizable material and having a thickness which is preferably slightly less than that of the stationary contact 26. The arc runner has an opening corresponding to the shape of the stationary contact 26 and embraces the stationary contact on all sides thereof, except for the end face 91 of the stationary contact 26. While the arc runner 100 so embraces the stationary contact 26 it is also slightly spaced therefrom. The arc runner 100 includes end faces 101 on opposite sides of the stationary contact 26 which are coplanar with, i.e., are cotermineous with, the end faces 91 and 92 of the stationary contacts 26 and of the conductor 23, respectively.

The arc runner 100 further includes two integral ears 104 (one on each side of the stationary contact 26) having a length at least as long as the stationary contact 26 and a width sufficient to extend into slots two opposed 105 formed in the half cases 12 and 14, thus providing substantial masses of magnetizable material immediately adjacent to and on opposite sides of the stationary contact 26, as shown. The masses of the ears 104 provide a heat sink and aid in thermal dissipation of the plasma energy generated by the arcs. The ears 104 are formed by bent portions of the arc runner 100 and have end faces 107 that are extensions of the end faces 101 and coplanar therewith.

The arc runner 100 also includes two tabs 110 bent down along the opposite sides of the conductor 23, as shown, the tabs being generally flush with the underside of the conductor 23.

The two feet 112, in addition to mechanically helping to secure the arc runner to the conductor 23, also importantly provide a metallic path for the magnetic flux of the electrical field surrounding the conductor 23, which establishes a more efficient magnetic circuit around the conductor 23 to better assist in extinguishing the arcs.

Figure 2:
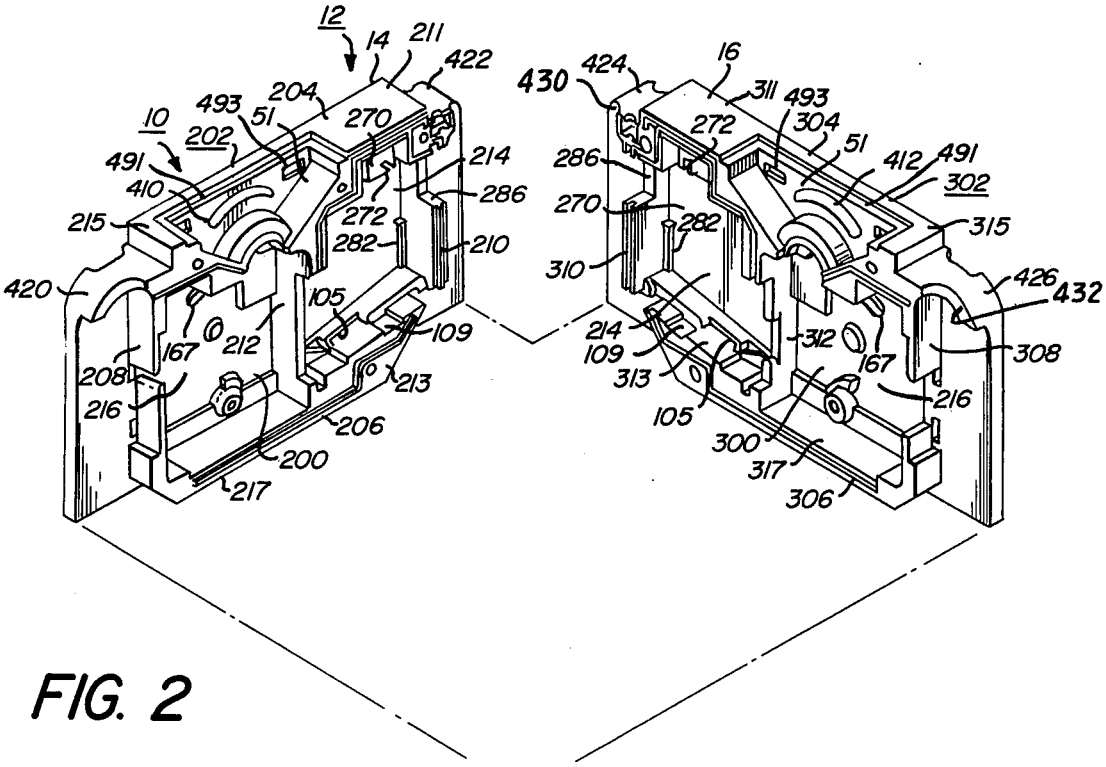
FIG. 2 is a top perspective view of the two half cases for the central pole shown in FIG. 1, showing the interior walls, but omitting all other parts.

The two feet 112 are received in two suitable depressions 109 formed in the half cases 14 and 16, as shown in FIG. 2.

The arc runner 100 further has a central elongated slot 116 which tightly receives a rib 117 of the conductor 23. The rib 117 is pressed outwardly or deformed from a central portion of an conductor 23 when the latter is formed. Thus, the arc runner 100 is keyed to the conductor 23 by the slot 116 and rib 117 which is supplemented by the tabs 110 and feet 112.

Since the conductor 23 is preferably of copper material and the arc runner 100 is of less expensive magnetizable material, formation of the ears 104 on the arc runner permits the use of a copper conductor having a width which is only as wide as the distance between the ears 104, whereas previously when the ears 104 were integral with the conductor 23 its width had to include them.

The case half 14 comprises a side wall 200 and a peripheral wall 202 defined by a top wall 204, a bottom wall 206 and opposed end walls 208 and 210. Projecting from the side wall 200 is an intermediate wall 212 which together with the end wall 210 on one side and portions 211 and 213 (of the top wall 204 and bottom wall 206, respectively) defines one half of an arcing chamber 214. The intermediate wall 212 together with the end wall 208 and portions 215 and 217 (of the top wall 204 and bottom wall 206, respectively) defines one half of the main compartment 216 for the mechanism.

The case half 16 similarly comprises a side wall 300 and a peripheral wall 302 defined by a top wall 304, a bottom wall 306, and opposed end walls 308 and 310. Projecting from the side wall 300 is an intermediate wall 312 which together with the end wall 310 on one side and portions 311 and 313 (of the top wall 304 and bottom wall 306, respectively) defines one half of an arcing chamber 214. The intermediate wall 312 together with the end 308 and portions 315 and 317 (of the top wall 304 and bottom wall 306 respectively) defines one half of the main compartment 216 for the mechanism.

Referring to FIG. 3, the main compartment 216 is separated from the arcing chamber 214 by the insulator plate 250. As seen in FIG. 3, the insulator plate 250 has two sections, a vertical section 251 and a horizontal section 252, the vertical section 251 being the portion which separates the arcing chamber 214 from the main compartment 216, the movable arm 30 extending through the vertical section 251, as shown.

The arcing chamber 214 includes an inverted U-shaped section 270 formed by parts of the top walls 211 and 311. The opposed side walls 200 and 300 each include a rectangular projection 272 which together with the corresponding parts of the top walls 211 and 311 define two inverted U-shaped notches 277 (one of which is shown in FIG. 3) to receive marginal portions of an inverted U-shaped insulator 274.

Each of the two projections 272 have an inclined notch 276 to receive the upper portion of a V-shaped screen 280. The apex of the V-shaped screen 280 rests on lugs 282 projecting from the opposed side walls 200 and 300. The vertical leg 284 of the V-shaped screen is placed alongside an opening 286 defined in the end walls 210 and 310 through which the arc gases are vented.

The bulk of the arc gases pass first through the sloping screen leg 288, then through the space 290 between the legs 284 and 288, and then through the vertical leg 284. However, some of the arc gases do expand into the inverted U-shaped chamber 270 and make an "end run" over the sloping leg 288 into the space 290 before venting through the vertical leg 284 and the opening 286. An array of grids 350 of magnetizable material, suitably supported, are also provided in the arcing chamber 214, as shown.

To insure that all of the arc gases pass through both legs 284 and 288 of the screen, the sloping leg 288 may be extended to the insulator 274 and the notches 276 would then require a corresponding extension.

The top walls 204 and 304 jointly define the previously mentioned, approximately V-shaped deep well 51, as shown in FIGS. 2 and 3, approximately one-half of the well 51 being formed in each half case 14 and 16. Each half case 14 and 16 has a side wall, tapered opposite walls, and an arcuate wall extending between the tapered walls and projecting from the side wall, as shown in FIG. 2, to form one half of the deep well 51. The actuator 50 extends into the well 51, as shown in FIG. 3.

Attached to the upper portion of the actuator 50 is a handle or manual operator 402 which extends out beyond the well 51, as shown in FIG. 3. The handle 402 is provided with an opening to receive and mate with the actuator 50. Further, the actuator 50 and the handle 402 also have aligned openings through which a pin 404 extends to secure the two together. The operator 402 is preferably a separate piece from the actuator 50 so that the handle 402 may be color coded to the rating of the circuit breaker. The actuator 50 and operator 402 (in the center pole 10) could be made as one piece.

The adjacent (end) poles 8 and 9 have actuators which are similar to the actuator 50 of the central pole 10 and they also have walls similar to the well 51, but they do not have corresponding handles similar to the handle 402. Instead, cover plates or caps 421 and 423, FIG. 1, are provided to cover the wells in the end poles 8 and 9. These plates 421 and 423 have flexible leg portions (not shown) with cams which snap into suitable grooves (not shown) but formed in the side walls of the half cases of the poles 8 and 9. The cover plates fit into recesses so that the upper surface of the cover plates become coplanar with the upper surface of the half cases, as shown. A recess 491 and grooves 493 for a cover plate are shown in FIG. 2 but since the half cases 14 and 16 shown in FIG. 2 correspond to the case of the center pole 10 it is understood that this recess 491 and grooves 493 do not receive a cover plate, but the end poles 8 and 9 are provided with corresponding recesses and grooves for the plates 421 and 423.

The pin 404 has a length sufficient to interconnect all of the actuators for unitary movement thereof extending through them. For this purpose, the side walls (of the half cases 14 and 16) are provided with arcuate slots 410 and 412, respectively, between the opposed tapered walls of the well 51.

The end poles 8 and 9 have half cases which abut the central pole 10 and the half cases which abut the central pole 10 are provided with arcuate slots corresponding to the slots 410 and 412, but they are not shown, so that the pin 404 may extend through them to interconnect the three actuators. The outer most half cases of the end poles 8 and 9 need not be provided with any such slots since the pin 404 does not extend through them and, hence, they are preferably not provided with any such slots, as shown.

As shown in FIGS. 1, 2 and 3, the half case 14 is provided with overhanging shrouds 420 and 422 curving downwardly at opposite ends thereof which extend from the side wall toward the other half case 16. Likewise, the half case 16 is provided with similar overhanging shrouds 424 and 426 curving downwardly at opposite ends thereof which extend from the side wall toward the shrouds 420 and 422.

Thus, the shrouds 422 and 424 overhang the connector 90 (of the terminal 22) but are cut away from each other only enough to define an opening 430 through which a suitable tool may extend to engage the screw of the connector 90.

Likewise, the shrouds 420 and 426 overhang the connector of the terminal 20 but are cut away to define an opening 432 for the same purpose.

The downwardly curved shrouds 422 and 424 act to deflect downwardly any arc gases which escape through the opening 286, FIG. 3, to help avoid flashover or dielectric breakdown with any metallic enclosure or mounting plate (not shown). Since the top surface of the circuit breaker may be mounted to a metal enclosure (not shown), the shrouds, since they are formed of electrical insulating material, i.e., the material of the molded case, provide dielectric material between the metal of the enclosure and the circuit breaker parts which are electrically energized.

It should be noted that the end walls 210 and 310 together with the portions of the side walls 200 and 300 which extend beyond the end walls 210 and 310 together form a recess which receives the connector 90 and the shrouds 422 and 424 overhang this entire recess. Likewise, the end walls 208 and 308 together with the portions of the side walls 200 and 300 which extend beyond the end walls 208 and 308 together form a recess which receives the connector 89 of the terminal 20, FIG. 3, and the shrouds 420 and 426 overhang the entire recess.

What is claimed is:

1. A multi-pole circuit breaker unit comprising
at least two poles in side-by side abutment, each pole including a case of electrical insulating material,
a linkage mechanism and an electromagnetic device for actuating said linkage mechanism on predetermined overloads,
a movable contact and a stationary contact, said linkage mechanism including a movable arm carrying said movable contact into and out of engagement with said stationary contact,
said case being divided longitudinally through its width into two approximate half cases,
said linkage mechanism including an actuator,
said case defining a compartment for said linkage mechanism and a V-shaped well separated by wall structure from said compartment,
said wall structure having an opening through which said actuator extends into said V-shaped well,
one of said actuators extending beyond said well to be manually grasped for manually opening and closing the contacts, and
interconnecting means extending through said actuators, through the V-shaped wells, and through the abutting half cases of abutting poles for joint movement of said actuators.

2. The combination of claim 1 and further including
a cap for each well through which an actuator does not extend.

3. A multi-pole circuit breaker unit comprising
at least two poles in side-by side abutment, each pole including
a case of electrical insulating material,
a linkage mechanism and an electromagnetic device for actuating said linkage mechanism on predetermined overloads,
a movable contact and a stationary contact, said linkage mechanism including a movable arm carrying said movable contact into and out of engagement with said stationary contact,
said case being divided longitudinally through its width into two approximate half cases,
said linkage mechanism including an actuator,
a V-shaped well defined by said case into which said actuator extends,
one of said actuators extending beyond said well to be manually grasped for manually opening and closing the contacts,
the abutting half cases of abutting poles having slots, and
a pin connecting said actuators and extending through said slots.

4. The combination of claim 3 wherein
said cap has flexible legs with cam-like portions, and
said half cases have recesses formed in the parts of said half cases which define said wells to receive said cam-like portions of said legs to form a snap connection between a cap and two half cases.

5. A multi-pole circuit breaker unit comprising
at least two poles in side-by side abutment, each pole including
a case of electrical insulating material,
a linkage mechanism and an electromagnetic device for actuating said linkage mechanism on predetermined overloads,
a movable contact and a stationary contact, said linkage mechanism including a movable arm carrying said movable contact into and out of engagement with said stationary contact,
said case being divided longitudinally through its width into two approximate half cases,
said linkage mechanism including an actuator,
a V-shaped well defined by said case into which said actuator extends,
one of said actuators extending beyond said well to be manually grasped for manually opening and closing the contacts,
a cap for each well through which an actuator does not extend,
the abutting half cases of abutting poles having slots,
and a pin connecting said actuators and extending through said slots,
said cap has flexible legs with cam-like portions, and
said half cases have recesses formed in the parts of said half cases which define said wells to receive said cam-like portions of said legs to form a snap connection between a cap and two half cases.

* * * * *